US007247091B2

(12) United States Patent
Moody

(10) Patent No.: US 7,247,091 B2
(45) Date of Patent: Jul. 24, 2007

(54) VIDEO POKER GAMES

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 549 days.

(21) Appl. No.: 10/379,155

(22) Filed: Mar. 3, 2003

(65) Prior Publication Data

US 2003/0166411 A1 Sep. 4, 2003

Related U.S. Application Data

(60) Provisional application No. 60/361,747, filed on Mar. 4, 2002.

(51) Int. Cl.
*A63F 1/00* (2006.01)
*A63F 13/00* (2006.01)
*G07F 17/34* (2006.01)

(52) U.S. Cl. ..... 463/13; 463/20; 273/292

(58) Field of Classification Search ..... 463/13, 463/12, 20; 273/292, 143 R, 274, 309, 138.2, 273/138.1

See application file for complete search history.

(56) References Cited

U.S. PATENT DOCUMENTS

| | | | | |
|---|---|---|---|---|
| 5,803,809 | A * | 9/1998 | Yoseloff | 463/13 |
| 5,823,873 | A | 10/1998 | Moody | 463/13 |
| 6,050,568 | A | 4/2000 | Hachquet | 273/292 |
| 6,419,578 | B1 * | 7/2002 | Moody et al. | 463/13 |
| 6,517,074 | B1 | 2/2003 | Moody et al. | 273/292 |
| 2001/0009865 | A1 * | 7/2001 | Demar et al. | 463/20 |

* cited by examiner

*Primary Examiner*—Benjamin Layno
(74) *Attorney, Agent, or Firm*—John Edward Roethel

(57) ABSTRACT

Whenever the player achieves one of the predetermined types of winning hand combinations on the original round of play of the hand of video poker, then the player is awarded one or more additional hands of video poker on the next round of play. The player may also receive a monetary payout on the original hand in addition to the extra hands of play on the additional round. The award of one or more additional hands may continue consecutively as long as the player continues to achieve one of the predetermined types of winning hand combinations on the previous round of play of video poker.

8 Claims, 2 Drawing Sheets

VIDEO POKER GAMES

CROSS-REFERENCE TO RELATED APPLICATION

This application is based on and claims priority of Provisional Application Ser. No. 60/361,747, filed Mar. 4, 2002, entitled "Video Poker Games."

This invention relates primarily to video poker games, and more particularly to video poker games that are programmed to play on an electronic video poker machine. Based on achieving certain winning hand combinations, the player receives one or more extra hands on his next round of play in addition to game credits. This process can continue to allow the extra hands to create additional extra hands.

BACKGROUND OF THE INVENTION

Video poker that is played on an electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard fifty-two card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand.

In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. A payout table is established based on the number of coins wagered by the player and the type of poker hand achieved.

The classic draw poker machine has been modified to use Jokers as wild cards or to use Deuces (or even other cards) as wild cards. "Jokers Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

There are many poker formats used in video draw poker. These poker game formats include Jacks (or even Tens) or Better Draw Poker, Bonus Poker, Double Bonus Poker, Double Double Bonus Poker, Super Double Bonus Poker, Triple Bonus Poker, Deuces Wild Poker, Jokers Wild Poker, Deuces and Jokers Wild Poker, etc. Many electronic video poker gaming machines are provided with a menu so that the player can indicate his choice of the poker game format that the player wishes to play and the player then makes his wager based on upon that choice of poker game format. Each poker format has its own pay table associated therewith.

U.S. Pat. No. 5,823,873 (Moody) (the disclosure of which is incorporated herein by this reference) describes an electronic video gaming machine and method in which the player may play multiple hands at the same time. The player makes a wager for each separate hand to be played by the player. One hand of five cards is dealt all face up. The player selects none, one or more of the face up cards from the first hand as cards to be held. The cards that are held are reused from the first hand into all of the other hands. Replacement cards for the non-selected cards are dealt into the first hand and additional cards are then dealt to the first hand, if needed, so that the first hand has five cards. Additional cards are also dealt to all of the other hands so that each hand is a five card hand. The poker hand ranking of each five card hand is determined row by row. The player is then paid for any winning poker hands based on a pay table and the amount of the player's wager.

It is an object of the present invention to provide a new form of an electronic video poker game that provides the player with one or more additional video poker hands on the next round of play whenever the player achieves a certain winning hand combination on the original round of play.

It is a feature of the present invention that whenever the player achieves one of the predetermined types of winning hand combinations on the original round of play of video poker, then the player is awarded one or more additional hands of video poker on the next round of play. The additional hands of video poker on the next round of play are played according to the multihand poker method described in U.S. Pat. No. 5,823,873. The player may also receive a monetary payout on the original hand in addition to the extra hands of play on the additional round.

These one or more additional hands can be awarded with or without the player having to make an additional wager.

It is a further feature of the present invention that the award of one or more additional hands may continue consecutively as long as the player continues to achieve one of the predetermined types of winning hand combinations on the previous round of play of video poker.

It is an advantage of the present invention that the player is provided with one or more additional hands of video poker to play with or without having to make another wager. This increases the player's opportunity to achieve winning payouts without significantly increasing the monetary risk to the player.

Other objects, features and advantages of the present invention will become apparent from a consideration of the following detailed description.

SUMMARY OF THE INVENTION

The method of the present invention begins with the player playing a conventional hand of video poker. Whenever the player achieves one of the predetermined types of winning hand combinations on the original round of play of the hand of video poker, then the player is awarded one or more additional hands of video poker on the next round of play. The additional hands of video poker on the next round of play are played according to the multihand poker method described in U.S. Pat. No. 5,823,873. The player may also receive a monetary payout on the original hand in addition to the extra hands of play on the additional round.

These one or more additional hands can be awarded with or without the player having to make an additional wager. It is a further feature of the present invention that the award of one or more additional hands may continue consecutively as long as the player continues to achieve one of the predetermined types of winning hand combinations on the previous round of play of video poker.

DETAILED DESCRIPTION OF THE PREFERRED EMBODIMENTS

Figure 1:
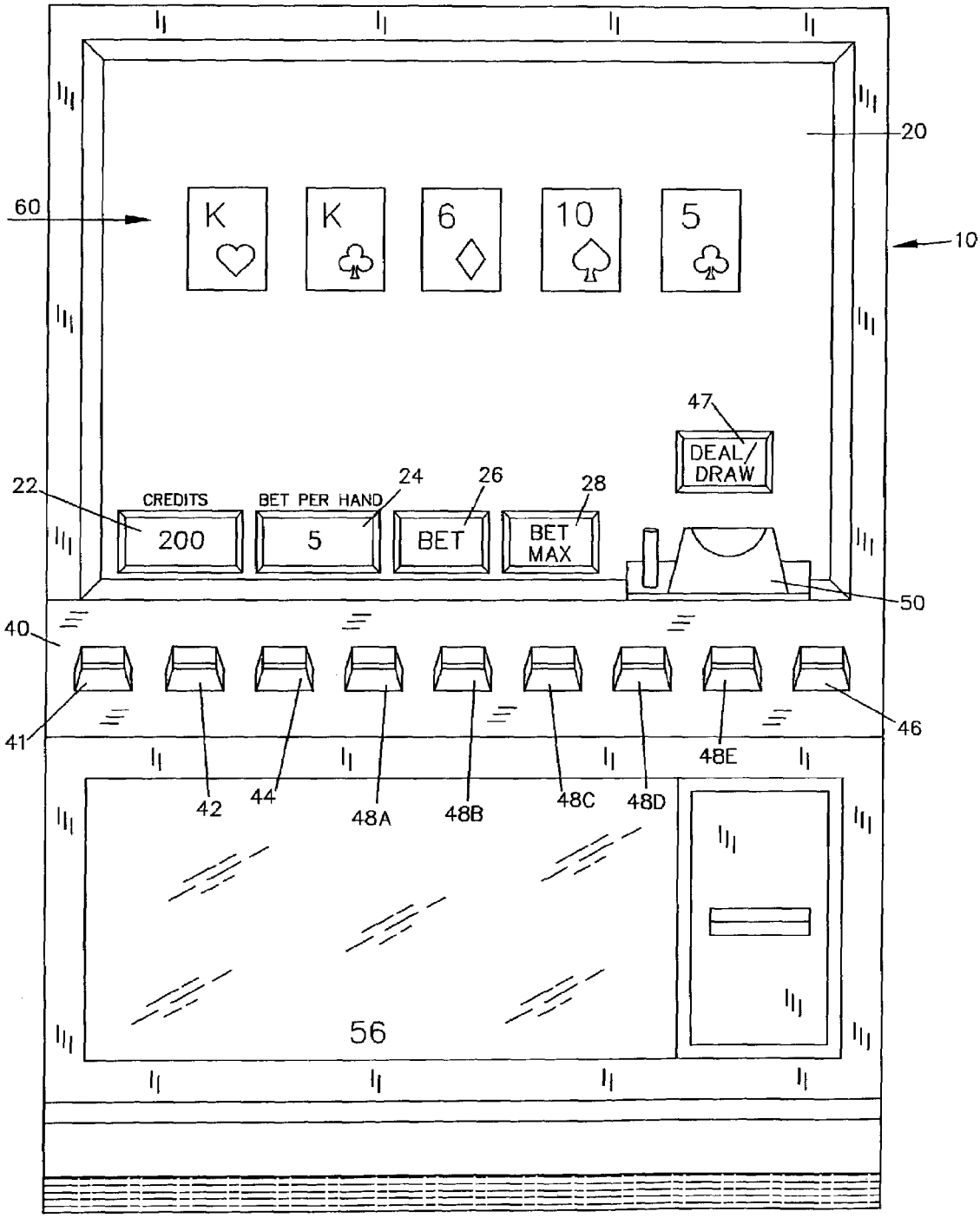
FIG. 1 shows a representative electronic video gaming machine of the present invention including a typical screen display used in the method of play of the present invention after the initial deal of the cards.

The method of the present invention can be applied to any poker format used for video poker. FIG. 1 shows generally at 10 a typical electronic video gaming machine that is configured to provide to the player the method of the present invention. The electronic video gaming machine 10 includes a conventional coin head 50 into which the player can insert coins or gaming tokens and a slot 52 which leads to a conventional bill acceptor mounted on the interior of the gaming machine and into which the player can insert paper currency. The use of coins, tokens or paper currency is the mechanism by which the player wagers on the poker hands the player wishes to play. As is also conventional in electronic video gaming machines, a credit meter display 22 is provided to show the amount of credits that the player has accrued on the gaming machine 10—either by inserting coins, tokens or paper currency or from winning plays achieved by the player. Whenever the player makes a wager, the amount of the wager is decremented from the credit meter display 22. Whenever the player achieves a winning play during the play of the game, the amount of the winning play is incremented on the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer or other cashless payout devices.

The gaming machine 10 also includes a video screen display 20 of any suitable type upon which representations of playing cards are displayed. In a preferred embodiment of the present invention, one or more hands can be displayed on the video screen display 20 at the same time. As shown in FIG. 1, a first hand: HAND ONE 60 is shown. Each hand would preferably have five card locations preferably from left to right in a horizontal row, although other manners of displaying single or multiple hands can be used. The video screen display 20 also contains a location at which the amount wagered on each hand is shown, for example, "Bet Per Hand" 24.

A button panel 40 is also provided on the gaming machine 10 and the buttons mounted on the button panel 40 are used by the player to control the operation of the gaming machine 10. Any suitable configuration of the buttons on the button panel can be used and, alternatively, conventional touch screen technology can be used for any or all of the buttons mounted on the button panel.

A typical button arrangement is shown on the button panel 40 in FIG. 1. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively, a BET ONE location 26 and a BET MAX location 28 can be provided on the video screen 20 to allow the player to wager by using conventional touch screen technology.

A conventional "DEAL/DRAW" button 46 is also provided on the button panel 40 which is used by the player to activate the initial deal of the cards at the deal stage of the method of play or the dealing of replacement cards at the draw stage of the method of play as is appropriate. Similarly, a DEAL/DRAW location 47 can be provided on the video screen 20 to allow the player to effect either the deal step or the draw step by using conventional touch screen technology.

The button panel 40 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location.

The method of play of the various versions of the present invention will now be described. After the player has inserted an appropriate amount of coins, tokens or paper currency to add a sufficient amount of credits on the credit display meter 22, the player makes his initial wager. The player may press the BET ONE button 42 one or more times to bet in single increments or the player may merely press the "BET MAX" button 44 and the maximum number of credits are applied, for example, five credits would be wagered. The player can also use the touch screen locations to make his wager as described above.

One of the preferred embodiments of the present invention is played using a standard fifty-two card deck. The player makes a wager to participate in the method of play. A first five card hand, HAND ONE 60 shown in FIG. 1, is dealt to the player.

The player then decides which cards he wishes to hold from the HAND ONE 60 as is conventional in video poker. After the player has made the selection of which cards the player wishes to hold, if any, replacement cards are displayed for the discarded cards in HAND ONE 60 and replacement cards are displayed for the discarded cards in the second hand as is conventional in video poker. The replacement cards for the discarded cards from HAND ONE 60 are dealt from the remaining forty-seven card deck which comprises the original fifty-two card deck minus the five originally dealt cards as is conventional in video poker. The final five card hand is analyzed to determine the poker hand ranking of the final five card hand. Depending on the poker hand ranking of the final five card hand, the player wins or loses according to the pay table being used again as is conventional in video poker.

For example, as shown in FIG. 1, the player is dealt the King of Hearts, the King of Clubs, the Six of Diamonds, the Ten of Spades and the Five of Clubs in HAND ONE 60.

Figure 2:
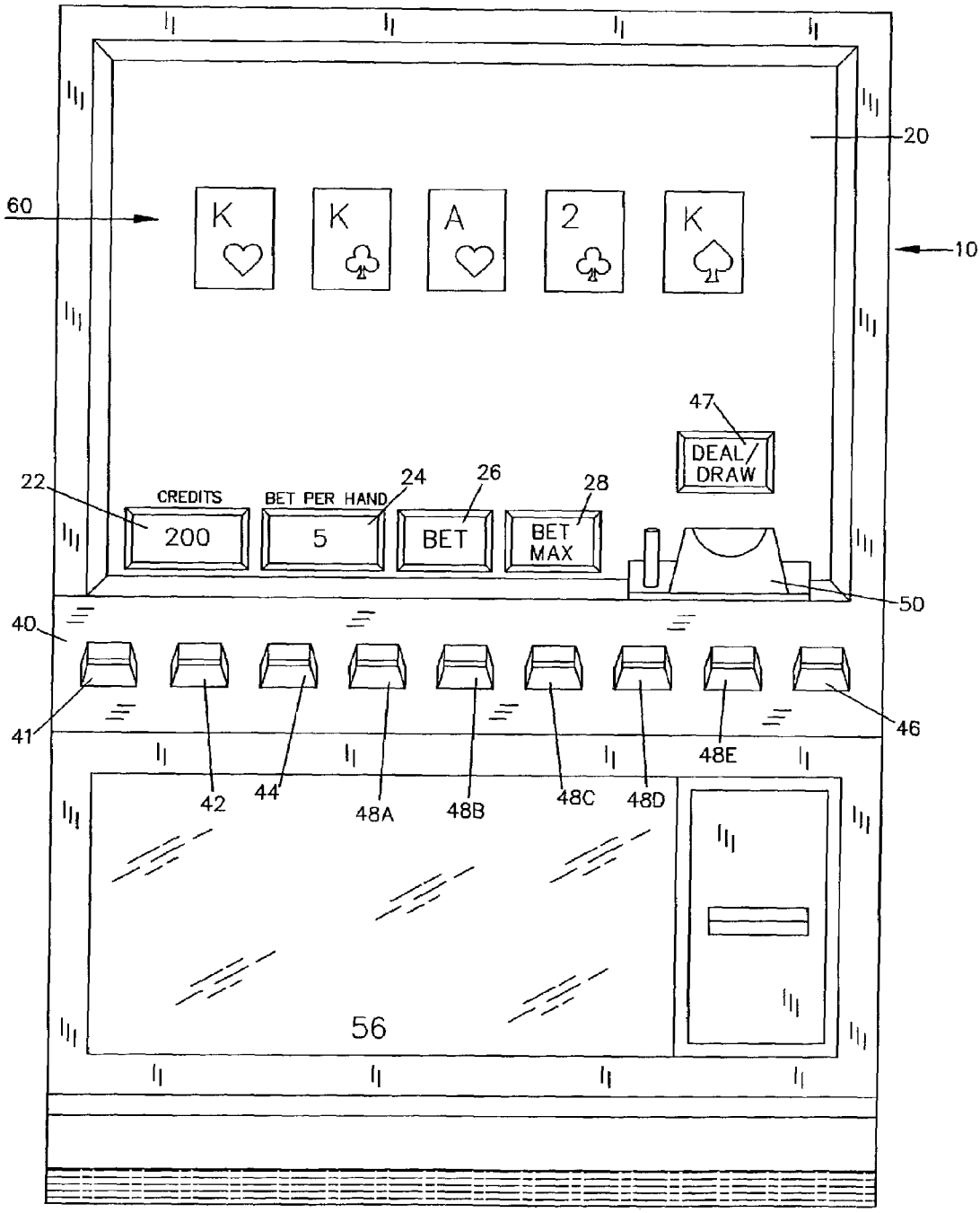
FIG. 2 shows a representative electronic video gaming machine of the present invention including a typical screen display used in the method of play of the present invention after the draw step and the dealing of replacement cards.

The player would most probably hold the Pair of Kings and discard the other three cards. Following along with this example, as shown in FIG. 2, the replacement cards dealt were the Ace of Hearts, the Two of Clubs and the King of Spades. The player's final HAND ONE 60 results in a poker hand ranking of Three-of-a-Kind.

Based on achieving certain winning hand combinations, the player receives one or more extra hands on his next round of play in addition to winning game credits which are accrued on the credit meter 22. In one embodiment of this invention, the method of play can continue to allow the extra hands to create additional extra hands.

Any suitable pay table may be used and would be associated with the poker format being used by the player. For example, the classic poker hand format is Jacks or Better Draw Poker. A suitable pay table for Jacks or Better Draw Poker played in accordance with one of the embodiments of the method of play of the present invention is shown in Table 1:

| JACKS OR BETTER DRAW POKER | NUMBER OF COINS WAGERED | | | | |
|---|---|---|---|---|---|
| POKER HAND RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 6** | 12** | 18** | 24** | 30** |
| FLUSH | 4** | 8** | 12** | 16** | 20** |
| STRAIGHT | 3* | 6* | 9* | 12* | 15* |
| THREE-OF-A-KIND | 2* | 4* | 6* | 8* | 10* |
| TWO PAIR | 2 | 4 | 6 | 8 | 10 |
| JACKS OR BETTER | 1 | 2 | 3 | 4 | 5 |

TABLE 1

The numerical amount shown in each cell corresponds to the number of credits won by the player based on the amount wagered on the hand. The symbol "*" corresponds to a free hand to be awarded to the player on the next round of the game: a single "*" means the player wins one free hand and a double "**" means the player wins two free hands.

For example a Three-of-a-Kind might pay two credits for each credit wagered and one extra hand on the next round. A Straight might pay three credits for each credit wagered and one extra hand on the next round. A Flush might pay four credits for each credit wagered and two extra hands on the next round. A Full House might pay six credits for each credit wagered and two extra hands on the next round.

When the player makes a wager to play the next round, the amount of the wager that is made for HAND ONE is also allocated also to the extra hand or hands as if the player had actually wagered that amount on the extra hand or hands.

For example, if the player bet five credits on the first round of play and ended with a Flush, he would receive a payout of twenty credits as well as two extra hands on the next round of play that would have a wager of five credits. The player would have to make a wager on the first hand in the next round of play to receive the extra hand bonus. In this example, the player would then be playing three hands after having made only a five credit wager, although each of the three hands would be analyzed as if a five credit wager had been made on each hand.

In this example, the three hands would be played in the manner described in U.S. Pat. No. 5,823,873, in which cards that are held in the first hand are reused as held cards in the other hands. Each of the final five card hands are analyzed to determine if any winning poker hand combinations have been achieved.

In one embodiment of the present invention, the method of play ends after this second round of play. In another embodiment of the present invention, the method of play would continue with the player being awarded additional extra hands if designated winning poker hand combinations are achieved during this second round of play.

For example, if the player achieved two Flushes on the second round of play, the player would receive the designated credit payout and four extra hands on the following round of play and thus the player would play a total of five hands if the player makes a five credit wager for this round of play. Again, the play of the extra hands would be played in the manner described in U.S. Pat. No. 5,823,873, in which cards that are held in the first hand are reused as held cards in the other hands. Each of the final five card hands are analyzed to determine if any winning poker hand combinations have been achieved.

Alternatively, the play of the extra hands can be played in the manner described in U.S. Pat. No. 6,050,568 (Hachquet), the disclosure of which is incorporated herein, in which the extra hands are displayed and the player may hold and draw in each hand independently. Likewise the play of the extra hands can be played in the manner described in U.S. Pat. No. 6,517,074 (Moody et al.), the disclosure of which is incorporated herein, in which the extra hands are displayed seriatim and the player may hold and draw in each hand independently.

The method of play of the present invention can be applied to any of the myriad of poker hand formats that are in use. Poker hand formats that use wild cards, including those that use one or more Jokers, can be used in the method of the present invention.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) playing a first round of play of the card game by displaying a first initial hand of at least five cards all face up to a player;

b) the player selecting none, one or more of the face up cards from the first initial hand as cards to be held, discarding the unselected cards and displaying replacement cards for the discarded cards resulting in a first final hand;

c) determining the poker hand ranking of the first final hand; and d) if the poker hand ranking of the first final hand results in a predetermined arrangement of cards, awarding the player at least two initial additional face up hands on a next round of play of the card game, each initial additional hand having the same cards by suit and rank;

e) the player selecting none, one or more of the face up cards as cards to be held, discarding the unselected cards and displaying replacement cards for the discarded cards resulting in at least two additional final hands, and awarding the player for any final hand that has a winning card combination.

2. The method of claim 1 in which the predetermined arrangement of cards is selected from the group consisting of a Three-of-a-Kind, a Straight, a Flush and a Full House.

3. The method of claim 1 further including the steps of:

a) the player making a wager;

b) additionally paying the player at least a pre-established amount based on the amount of the wager if the resulting cards of the final first hand comprise a predetermined poker hand ranking.

4. The method of claim 3 in which the predetermined arrangement of cards is selected from the group consisting of a Three-of-a-Kind, a Straight, a Flush and a Full House.

5. A method of playing a card game comprising:

a) playing a first round of play of the card game by displaying a first initial hand of at least five cards all face up to a player;

b) the player selecting none, one or more of the face up cards from the first initial hand as cards to be held, discarding the unselected cards and displaying replacement cards for the discarded cards resulting in a first final hand;

c) determining the poker hand ranking of the first final hand;

d) if the poker hand ranking of the first final hand results in a predetermined arrangement of cards, awarding the player at least two initial additional face up hands on a next round of play of the card game, each initial additional hand having the same cards by suit and rank;

e) the player selecting none, one or more of the face up cards as cards to be held, discarding the unselected cards and displaying replacement cards for the discarded cards resulting in at least two additional final hands, and awarding the player for any final hand that has a winning card combination;

f) allowing the player to continue to play each round of play and awarding the player at least two additional hands on each succeeding round of play whenever the player achieves a final hand having a predetermined arrangement of cards.

6. The method of claim 5 in which the predetermined arrangement of cards is selected from the group consisting of a Three-of-a-Kind, a Straight, a Flush and a Full House.

7. The method of claim 5 further including the steps of:

a) the player making a wager;

b) additionally paying the player at least a pre-established amount based on the amount of the wager if the resulting cards of the final first hand comprise a predetermined poker hand ranking.

8. The method of claim 7 in which the predetermined arrangement of cards is selected from the group consisting of a Three-of-a-Kind, a Straight, a Flush and a Full House.

* * * * *